United States Patent [19]

Moldovan et al.

[11] Patent Number: 4,486,733

[45] Date of Patent: Dec. 4, 1984

[54] THERMAL MECHANISM WITH AMBIENT COMPENSATING BIMETAL PROVIDING TRIP FORCE

[75] Inventors: Peter K. Moldovan, Cascade; John C. Hohensee, Milwaukee, both of Wis.

[73] Assignee: Eaton Corporation, Cleveland, Ohio

[21] Appl. No.: 428,503

[22] Filed: Sep. 29, 1982

[51] Int. Cl.[3] ..... H01H 71/16

[52] U.S. Cl. ..... 337/101; 337/99; 337/378

[58] Field of Search ..... 337/101, 99, 124, 378, 337/78, 75, 70

[56] References Cited

U.S. PATENT DOCUMENTS

| | | | |
|---|---|---|---|
| 1,513,210 | 10/1924 | Banan | 337/11 |
| 2,284,383 | 5/1942 | Elmer | 337/101 |
| 2,446,831 | 8/1948 | Hattenroth, Jr. | 337/38 |
| 3,183,328 | 5/1965 | Wheeler | 337/56 |
| 3,257,526 | 6/1966 | Ramsey et al. | 337/38 |
| 3,701,962 | 10/1972 | Ball et al. | 337/101 |
| 3,825,868 | 7/1974 | Jess et al. | 337/112 |

*Primary Examiner*—Harold Broome

*Attorney, Agent, or Firm*—C. H. Grace; W. A. Autio

[57] ABSTRACT

An electrothermal responsive protective mechanism for an electrically powered load wherein the overload tripping force is provided by the cool, ambient temperature compensating bimetal (12) rather than the hot electrically heated bimetal (6) to prevent over-stress. The bimetal members (6,12) are preloaded by a link actuator (22) having a positive temperature coefficient of expansion to minimize unloading of the bimetal members due to ambient temperature change thereby to prevent tripping motion. A screw (16) adjusts the preload and a screw (24) provides a coupling gap in the tripping linkage to prevent shock or vibration propagation therethrough. An insulating base (2) and carrier (14) provide thermal and electrical isolation of the bimetal members. Identical bimetal members (6,12) are used to prevent any actuator motion under ambient temperature changes.

14 Claims, 2 Drawing Figures

THERMAL MECHANISM WITH AMBIENT COMPENSATING BIMETAL PROVIDING TRIP FORCE

BACKGROUND OF THE INVENTION

Ambient temperature compensating bimetal mechanisms have been known heretofore. However, in such prior thermal mechanisms, it has been the practice generally to use bimetal deflection with temperature to perform work. In such mechanisms, the high work demand occurs when the bimetal is hot and is weakest metallurgically, thereby involving physical damage to the bimetal due to the danger of over-stress. While these prior bimetal mechanisms have been useful for their intended purposes, they have nevertheless been handicapped by the fact that the highest work demand occurs when the bimetal is the hottest and structurally the weakest with its consequent susceptibility to over-stress and possible structural damage. It has, therefore, been found desirable to provide an improve bimetal mechanism wherein the electrically heated bimetal member that senses an overload condition or the like merely triggers or permits the unlatching function to take place while the actual work is performed by other means.

SUMMARY OF THE INVENTION

An object of the invention is to provide an improved ambient temperature compensated bimetal mechanism.

A more specific object of the invention is to provide an improved bimetal mechanism wherein the trip force is provided by means other than the electrically heated bimetal member.

Another specific object of the invention is to provide an improved thermal mechanism having an ambient temperature compensating bimetal member providing the trip force.

Another specific object of the invention is to provide an improved bimetal mechanism wherein a thermally cold bimetal member that is much more metallurgically strong than a thermally hot bimetal member is used for providing the unlatching force.

Another specific object of the invention is to provide a bimetal mechanism having excellent ambient temperature compensation.

Another specific object of the invention is to provide an improved bimetal mechanism wherein the ambient temperature compensating means has no effect on overload protection.

Another specific object of the invention is to provide an improved ambient temperature compensated bimetal mechanism wherein the arrangement is such as to provide consistent unlatching force by the electrically cold bimetal member.

Another object of the invention is to provide an improved bimetal mechanism that fails safe if the bimetal fuses or takes a permanent set.

A further specific object of the invention is to provide an improved ambient temperature compensated bimetal mechanism wherein the unlatching bimetal member has no susceptibility to electrically induced thermal fatigue damage and consequent unlatch force loss.

Other objects and advantages of the invention will hereinafter appear.

These objects of the invention are accomplished by providing an overload current responsive mechanism having a current responsive bimetal member and an ambient compensating bimetal member mounted at their opposite ends in parallel fashion and stressed in opposite directions by a solid actuator member interposed therebetween. The high expansion sides of these bimetal members face in opposite directions. In order to prevent any motion of the bimetal members during ambient temperature variations, the preload deflection on the bimetals by the interposed actuator is greater than any ambient variation induced deflection. Thus, ambient temperature variation merely reduces the preload stress or takes up a part of the preload deflection so that there is no motion of the actuator. The unloading, however, is minimized through the thermal expansion of the interposed actuator. Conversely, ambient temperature drops cause the bimetal members to move towards the actuator. Since the actuator is rigid, no physical bimetal motion results. However, the preload on the bimetal is increased under these conditions. Physical contraction of the actuator due to the colder ambient prevents bimetal overloading. Secondarily, the current carrying bimetal member is formed into a number of loops in order to optimize the electrical resistance and thermal heating, deflection force of the bimetal within the confines of the allowable mounting space. The ambient temperature compensating bimetal member has a similar form.

DESCRIPTION OF THE PREFERRED EMBODIMENT

Figure 1:
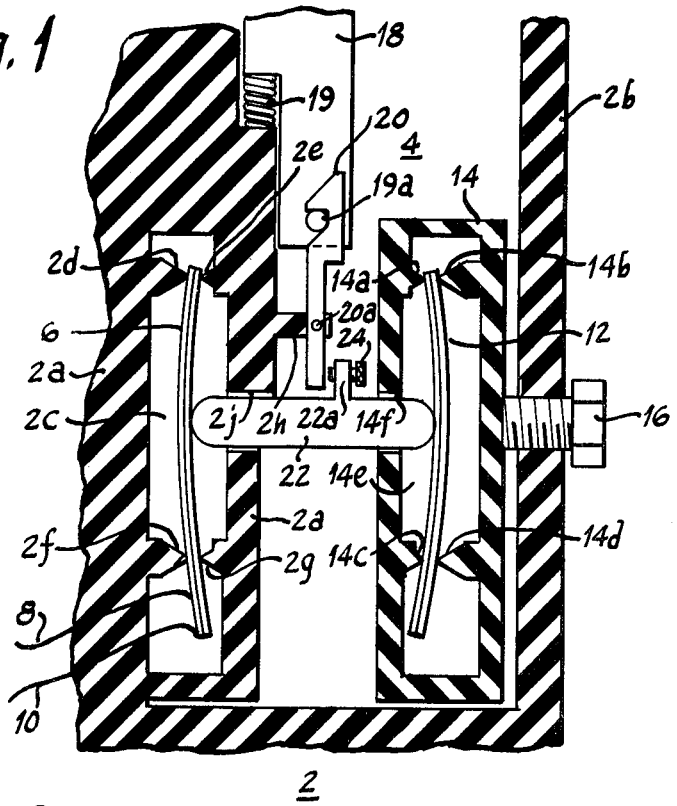
FIG. 1 is a cross sectional view of a thermal mechanism with ambient temperature compensating bimetal providing trip force constructed in accordance with the invention.

Referring to FIG. 1, there is shown a thermal mechanism with an ambient temperature compensating bimetal member providing the trip force constructed in accordance with the invention. As shown fragmentarily therein, the thermal mechanism is provided with an electrically insulating base 2 having a body portion 2*a* at the left hand side and a wall 2*b* at the right hand side spaced therefrom to provide a compartment therebetween. As schematically shown in FIG. 1, body portion 2*a* of the base is provided with means for supporting an electrically heated bimetal member 6. This means comprises a cavity 2*c* within body portion 2*a* having upper and lower pairs of laterally longitudinal pointed ridges 2*d*, 2*e* and 2*f*, 2*g* extending inwardly from the walls of cavity 2*c*, with the ridges of each pair opposite one another and spaced sufficiently apart to receive the upper and lower portions of bimetal member 6 therebetween thereby to mount bimetal member 6 in the housing.

Figure 2:
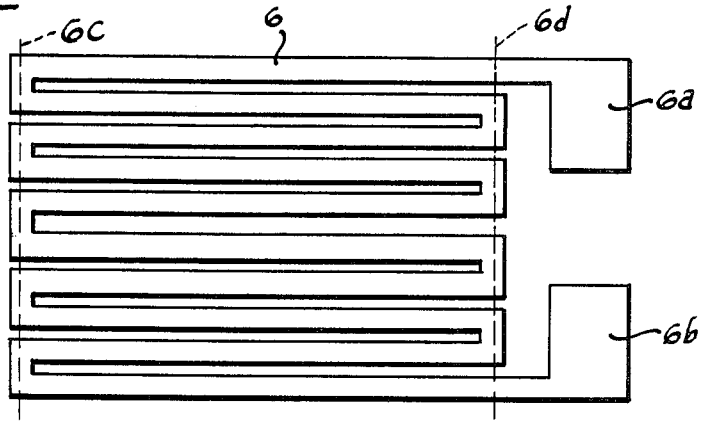
FIG. 2 is a plan view of one of the bimetal members used in FIG. 1.

Bimetal member 6 is formed as shown in FIG. 2 to optimize the electrical resistance and the thermal heating, deflection and force of the bimetal within the confines of the allowable mounting space. As shown in FIG. 2, and starting at thermal 6*a*, bimetal member 6 is looped to the left and then to the right and then to the left and then to the right a number of times to provide the structure shown therein and finally terminating in terminal portion 6*b*. Upper ridges 2*d* and 2*e* support the opposite sides of the left hand portion of bimetal 6 substantially along broken line 6*c* shown in FIG. 2. In a similar manner, lower ridges 2*f* and 2*g* in FIG. 1 support the right hand portion of bimetal member 6 substantially along broken line 6*d* shown in FIG. 2. A pair of electrical conductors 8 and 10 shown in FIG. 1 are connected to terminal portions 6*a* and 6*b*, respectively, shown in FIG. 2, and extend outside of the housing for connecting the electrically heated bimetal member 6 to an electrical circuit.

Temperature compensating bimetal member 12 shown in FIG. 1 is preferably identical to electrically heated bimetal member 6, with the exceptiion of the connected electrical conductors, and is similarly mounted in an electrically insulating carrier 14. For this purpose, two pairs of laterally longitudinal pointed ridges 14*a*, 14*b* and 14*c*, 14*d* extend inwardly from the walls of a cavity 14*e* within carrier 14, with ridges 14*a* and 14*b* of the upper pair pointing toward one another and ridges 14*c* and 14*d* of the lower pair pointing toward one another and the ridges of each pair being spaced apart sufficiently to support the upper and lower portions of temperature compensating bimetal member 12 therebetween. Carrier 14 may be mounted and guided in any desired manner for left and right movement within base 2. A screw 16 is threaded in a hole in wall 2*b* and abuts the right hand wall of carrier 14 and may be turned in or out to adjust the position of carrier 14 within the housing and thereby to adjust the preload on the bimetal members. While only one screw 16 has been shown for illustration purposes, it will be apparent that more than one screw may be used in spaced apart relation to adjust carrier 14 evenly within the housing.

An actuator member 18 is biased upwardly by an helical compression spring 19 which abuts a shoulder in body portion 2*a* of the housing. The lower end portion of actuator 18 has mounted thereon a lateral roller or pin 19*a* to serve as a catch for a latch hook 20 which is pivotally mounted by a pin 20*a* or the like to a projection 2*h* integrally formed with body portion 2*a* of the housing and extending into compartment 4. Actuator 18 may be used to trip open electrical power contacts or the like when latch 20 is released.

The thermal mechanism is further provided with means responsive to the bimetal members for releasing latch 20. This means comprises an electrically nonconductive link 22 extending between the center portions of bimetal members 6 and 12. Link 22 is a generally flat laterally longitudinal member spanning all the loops of both bimetal members and having rounded left and right ends as shown in FIG. 1 for engaging the vertically mid-portions of the bimetal members. The left end of link 22 extends through a lateral hole 2*j* in body portion 2*a* of the housing into engagement with bimetal member 6. The right end of link 22 extends through a lateral hole 14*f* in the left wall of carrier 14 into engagement with temperature compensating bimetal member 12. An integral projection 22*a* extends upwardly from the upper surface of link 22 and has an adjustable screw 24 threaded therethrough into close proximity with the lower end of latch 20 as shown in FIG. 1. Shock and vibration propagation from the bimetal members through actuator link 22 to the latch is prevented by maintaining a slight gap between actuator link 22 and the latch by means of adjusting screw 24. Actuator link 22 preferably has a positive temperature coefficient of expansion, that is, it expands when it gets hot and contracts when it is cooled for purposes hereinafter described.

As shown in FIG. 1, the electrically heated bimetal member 6 and the temperature compensating bimetal member 12 are mounted facing each other with the thermally high expansion sides thereof facing outwardly. These bimetal members are preloaded or deflected by way of the physical insertion of the actuator link 22 therebetween and the manipulation of adjusting screw 16. During ambient temperature variations, the bimetal members must not experience any relative motion with respect to each other to prevent any actuator link motion and possible unlatching. To assure this, the preload deflection of the two bimetal members must be greater than any ambient temperature variation induced deflection. That is, as the ambient temperature rises, the bimetal members will tend to deflect away from the actuator link. However, since the preloading of the bimetal members is greater than the ambient temperature unloading, the ambient temperature rise decreases the bimetal preload without any resultant bimetal member motion. Furthermore, the unloading is minimized through the thermal expansion of actuator link 22. For this purpose, this actuator link 22 is made of a material having the desired positive temperature coefficient of expansion.

Conversely, ambient temperature drops cause the bimetal members to tend to move towards the actuator link. Since the actuator link is rigid, no physical bimetal member motion results. However, the preload on the bimetal members is increased under this condition. Physical contraction of the actuator link due to the colder ambient temperature prevents bimetal member overloading.

This thermal mechanism operates as follows. Only bimetal member 6 is electrically energized. Consequently, the electrical current passing therethrough causes it to loose some of its preload. The resulting force unbalance between the two bimetal members causes bimetal member 12 to push bimetal member 6 a distance necessary to reestablish equilibrium. It is important to note that the electrically hot bimetal member 6 is allowing the electrically cold bimetal member 12 to push the actuator link whereby the latter moves into contact with the lower end of latch 20. Movement of actuator link 22 in the left hand direction in FIG. 1 under the force of bimetal member 12 causes latch 20 to pivot in the clockwise direction. When the energizing current flowing in bimetal member 6 has reached overload levels, link 22 rotates latch 20 sufficiently in the clockwise direction to release trip member 18 thereby to perform the protective function to which the thermal mechanism is being applied.

This thermal mechanism fails safe if the electrically heated bimetal fuses or takes a permanent set. If the energized bimetal yields only slightly, not enough to keep it from latching, it trips sooner on overload than normal. A conventional bimetal behaves oppositely and trips later, which is inherently unsafe.

While the two bimetal members 6 and 12 are shown mounted in a simple beam configuration, it will be apparent that other bimetal mounting configurations could be used. A matched pair of bimetal members that are identical in shape, size and temperature response are used. While both bimetal members 6 and 12 respond in equal amounts to ambient temperature changes, only electrically heated bimetal member 6 responds to overload currents to enable temperature compensating bimetal member 12 to do the work of tripping the latch mechanism. For this purpose, bimetal member 12 acts as a spring to provide the unlatching force. As shown by the configuration of base 2 and carrier 14 in FIG. 1, these two bimetal members are electrically and thermally isolated from one another to prevent the direct heating of bimetal member 6 from affecting the performance of bimetal member 12.

While the apparatus hereinbefore described is effectively adapted to fulfill the objects stated, it is to be understood that the invention is not intended to be confined to the particular preferred embodiment of thermal mechanism with ambient compensating bimetal providing trip force disclosed, inasmuch as it is susceptible of various modifications without departing from the scope of the appended claims.

We claim:

1. In a thermal protective mechanism having trippable means operable in response to an overthermal condition for protecting a load device supplied from an energy source, the improvement comprising:

thermal responsive means;

means for tripping said trippable means;

means for preloading said thermal responsive means comprising:

bias means; for providing a force and actuator means responsive to said force of said bias means for applying said preloading such that an over-thermal condition causes said thermal responsive means to relieve at least some of said preloading whereupon said bias means causes movement to said actuator means whereby said actuator means causes operation of said tripping means.

2. The thermal protective mechanism claimed in claim 1, wherein:

said bias means comprises:

an ambient temperature compensating means;

and said actuator means comprises a link actuator between said thermal responsive means and said ambient temperature compensating means preloading the same in opposite directions.

3. The thermal protective mechanism claimed in claim 2, wherein:

said thermal responsive means is a bimetal member;

and said thermal protective mechanism also comprises means mounting said bimetal member at opposite end portions with said preloading being applied by said link actuator to its intermediate portion.

4. The thermal protective mechanism claimed in claim 3, wherein:

said ambient temperature compensating means is a bimetal member;

and said thermal protective mechanism also comprises means mounting said compensating bimetal member at opposite end portions with said preloading being applied by said link actuator to its intermediate portion.

5. The thermal protective mechanism claimed in claim 4, wherein:

said bimetal members are alike in size, shape and response to temperature change.

6. The thermal protective mechanism claimed in claim 5, wherein;

said thermal responsive bimetal member is an electrically heated bimetal member.

7. The thermal protective mechanism claimed in claim 6, wherein:

each said bimetal member is a multiple-looped member having a series of reverse loops to provide optimum electrical resistance thermal heating, deflection and force within a minimum mounting space and equal response by the two bimetal members to ambient temperature changes.

8. The thermal protective mechanism claimed in claim 2, wherein:

said link actuator has a positive temperature coefficient of expansion to minimize the variations in said preloading due to ambient temperature changes.

9. The thermal protective mechanism claimed in claim 2, wherein:

said bias means comprises means for accurately adjusting the amount of said preloading.

10. The thermal protective mechanism claimed in claim 9, wherein:

said means for accurately adjusting the amount of said preloading comprises:

means for adjusting the position of said ambient termperature compensating means with respect to said thermal responsive means.

11. The thermal protective mechanism claimed in claim 1, wherein:

said actuator means comprises means for adjusting the coupling between said actuator means and said tripping means to prevent shock and vibration propagation therethrough.

12. The thermal protective mechanism claimed in claim 4, wherein:

said means mounting said thermal responsive bimetal member and said compensating bimetal member comprises thermal isolation to prevent heating of said thermal responsive bimetal member from affecting said compensating bimetal member.

13. In a thermal protective mechanism having trippable means operable in response to an electrical overload condition for disconnecting a load device from an electrical power supply source, the improvement comprising:

electrothermal responsive means;

ambient temperature compensating means;

preloading means including said ambient temperature compensating means for preloading said electrothermal responsive means which allows movement of said preloading means in response to an overload condition;

and said electrothermal responsive means being responsive to an overload condition to relieve some of said preloading whereby said ambient temperature compensating means provides the force for moving said preloading means whereby said preloading means causes operation of said tripable means.

14. In a thermal protective mechanism having trippable means operable in response to an over-thermal condition for protecting a load device supplied from an energy source, the improvement comprising:

thermal responsive means;

ambient temperature responsive means;

preloading means jointly and oppositely preloading said thermal responsive means and said ambient temperature responsive means such that when said thermal responsive means responds to an over-thermal condition to reduce the preload thereon, said ambient temperature responsive means provides the moving force for actuating said preloading means;

and means responsive to said actuation of said preloading means under said over-thermal condition for tripping said trippable means.

* * * * *